United States Patent [19]

Singler

[11] Patent Number: 4,813,654

[45] Date of Patent: Mar. 21, 1989

[54] ANNEALING FURNACE BASE CONSTRUCTION

[75] Inventor: John E. Singler, Fairview Park, Ohio

[73] Assignee: Lee Wilson Engineering Company, Inc., Rocky River, Ohio

[21] Appl. No.: 118,857

[22] Filed: Nov. 9, 1987

[51] Int. Cl.[4] ..... C21D 9/673

[52] U.S. Cl. ..... 266/262; 432/254.1

[58] Field of Search ..... 266/256, 262–264, 266/274, 287; 432/254.1, 254.2

[56] References Cited

U.S. PATENT DOCUMENTS

| | | | |
|---|---|---|---|
| 2,414,996 | 1/1947 | Armstrong | 266/256 |
| 2,504,809 | 4/1950 | Dailey, Jr. | 266/256 |
| 3,879,167 | 4/1975 | De Luca et al. | 266/274 |
| 4,023,782 | 5/1977 | Eifer | 266/285 |

FOREIGN PATENT DOCUMENTS

| | | | |
|---|---|---|---|
| 630356 | 11/1961 | Canada | 266/256 |
| 878497 | 10/1961 | United Kingdom . | |

*Primary Examiner*—Christopher W. Brody
*Attorney, Agent, or Firm*—Pearne, Gordon, McCoy & Granger

[57] ABSTRACT

A base for a heat treating furnace for annealing coils of steel strip. The base supports the coils in a sealed compartment through which an inert gas is circulated, and defines the bottom of the sealed compartment. The base comprises a top plate assembly, a floor, and side walls that define therein a sealed enclosure. The top plate assembly is supported on a plurality of upright, annular, concentric bearing partitions located in the enclosure that slidingly engage the bottom surfaces of the top plate assembly in a manner to accommodate radial thermal expansion and contraction. The spaces between the upright partitions are filled with a lightweight thermal insulating material. The top plate assembly comprises at least two coplanar plate sections located one-within-the-other and joined by an annular expansion joint. The joint has a "U" shape when viewed in cross section and accommodates radial thermal expansion and contraction of the top plate sections relative to one another.

6 Claims, 4 Drawing Sheets

ANNEALING FURNACE BASE CONSTRUCTION

BACKGROUND OF THE INVENTION

This invention relates to metallurgical processes, and especially to the construction of a heat treating furnace for annealing coils of metal strip. More particularly, the invention relates to an annealing furnace base that (1) provides thermal insulation between the sealed heat treating compartment and the surrounding atmosphere and (2) supports both the coil or coils of metal strip and a blower wheel and diffuser structure.

In the heat treatment of coiled metal strip, such as steel strip, tightly wound coils of the strip are supported with their axes vertical on an open, gridlike support structure in a sealed compartment, and hot inert gas is circulated through the compartment.

In the annealing process, the steel strip may be heated to as high as 1650° F. Other treatments may involve modifying the chemical composition of the metal. For example, the carbon content of steel strip may be modified by the use of a suitable gas. Furthermore, treatments may involve oxidation, bright annealing, gas alloying, and the application to the surface of materials that will react with the constituents of the metal.

The inert gas used in the annealing process is confined with the coils in a sealed annealing compartment enclosed by a portable inner cover that surrounds the coil or coils with its top and sides and that engages a sealing means at the bottom of the side walls.

The inner cover is surrounded by a portable bell that includes internal heating means or burners to heat the inner cover and the gas therein, and that insulates the inner cover from the surrounding atmosphere outside the furnace. The floor of the sealed compartment is defined by an insulating base that serves both to insulate the sealed compartment from the surrounding external support structure and to support the coil or coils to be annealed, along with a blower wheel and diffuser structure located between the base and the bottom of a coil.

The gas is circulated by a centrifugal blower located in the blower housing and a surrounding diffuser structure directs the hot gas in a somewhat tangential path to the side walls of the compartment where the gas proceeds upward to the top and then downward through the central axial opening in the coils.

It will be apparent that the furnace design must provide a support structure or base capable of supporting great weight particularly in view of the tremendous weight of the coils of steel strip. For this reason, it is desirable to minimize the weight of the furnace components as much as possible.

Many of the furnace components serve primarily an insulating function, and their weight may be minimized by using the lightest possible insulating material that still provides the desired thermal insulating properties. The furnace base, however, must have great strength in order to support the coils, blower housing, and diffuser structure. Accordingly, most lightweight insulating materials would not provide the compressive strength required by the base.

In the past, the furnace base has usually been constructed of steel exterior members to define an enclosure, and the enclosure was filled with a high strength, solid, castable ceramic material. The castable material is by nature quite heavy, and thus inconsistent with the goal of minimizing weight. Also, this base construction resulted in a need for a time-consuming dry-out procedure prior to each annealing operation.

Furthermore, the top plate of the enclosed base in prior art constructions is exposed to great thermal stresses caused by thermal expansion and contraction during the annealing process. These stresses cause fatigue that reduces the effective life of the base and presents a danger of failure that could cause leakage of gas into and out of the sealed annealing compartment.

The annealing furnace base construction of the present invention reduces the difficulties indicated above, and affords other features and advantages heretofore not obtainable.

SUMMARY OF THE INVENTION

It is among the objects of the present invention to reduce the weigh of the annealing compartment base in a heat treating furnace.

Another object of the invention is to minimize the stresses caused in the upper plate of an annealing furnace base, the stresses being those caused by thermal expansion and contraction during the annealing process.

Still another object of the invention is to eliminate the need for using a heavy, castable, ceramic material in the annealing compartment base of a heat treating furnace.

These and other objects and advantages are achieved by the unique annealing furnace base construction of the present invention. The base is uniquely suited for use in annealing coils of steel strip using the process whereby the strip is placed in a sealed compartment through which a hot, inert gas is circulated. The base defines the bottom of the sealed compartment, and is adapted to support thereon a blower housing and diffuser structure on which the coils of steel strip are placed. The base forms part of the sealed compartment in that the side walls are sealed relative to the base in such a way that intrusion of outside atmosphere or escape of inside atmosphere from the annealing compartment is prevented.

The base comprises a top plate, a floor, and side walls to define therein a sealed enclosure. Inside the enclosure and resting on the floor are a plurality of radially spaced, annular, concentric bearing partitions adapted to slidingly engage and support the top plate in a manner to promote sliding movement of the top plate thereon in response to thermal expansion and contraction. The partitions define with the side walls of the enclosure interior spaces that are filled with a lightweight, thermal insulating material. The top plate assembly comprises at least two circular sections located one within the other. The joint between the two sections comprises an annular expansion joint that seals the space between the two sections. The joint has a "U" shape when viewed in cross section so that any radial expansion or contraction of the two sections relative to one another is accommodated by the annular expansion joint.

In the preferred embodiment, arcuate pad segments are secured to the top of the corrugated partitions to provide a plurality of concentric annular rings or pads, the top surfaces of which slidingly engage the bottom surfaces of the sections of the top plate assembly.

DESCRIPTION OF THE PREFERRED EMBODIMENT

Figure 1:
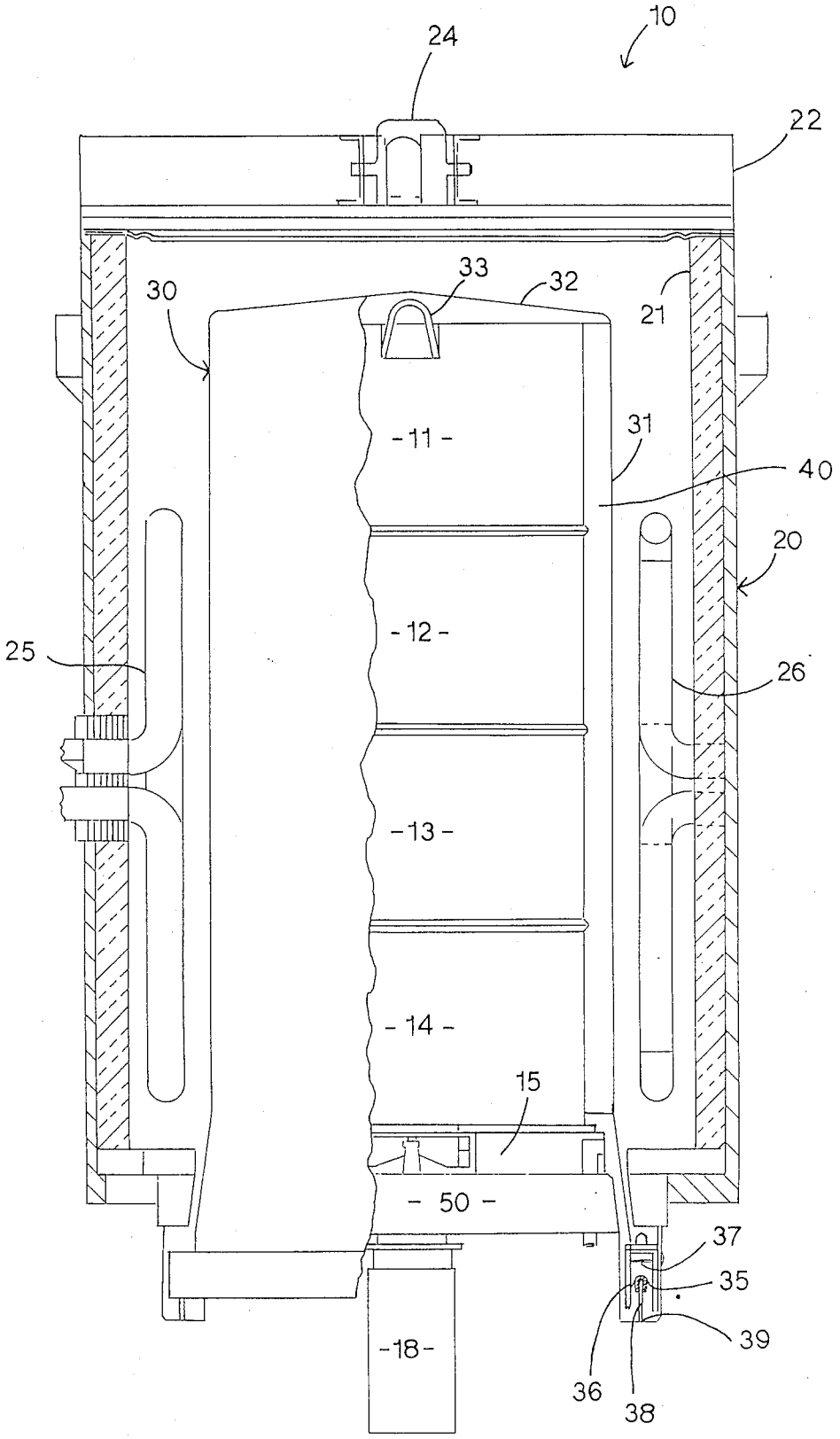
FIG. 1 is a vertical section through a heat treating furnace adapted to anneal coils of steel strip and which utilizes an annealing compartment base embodying the present invention.
Figure 2:
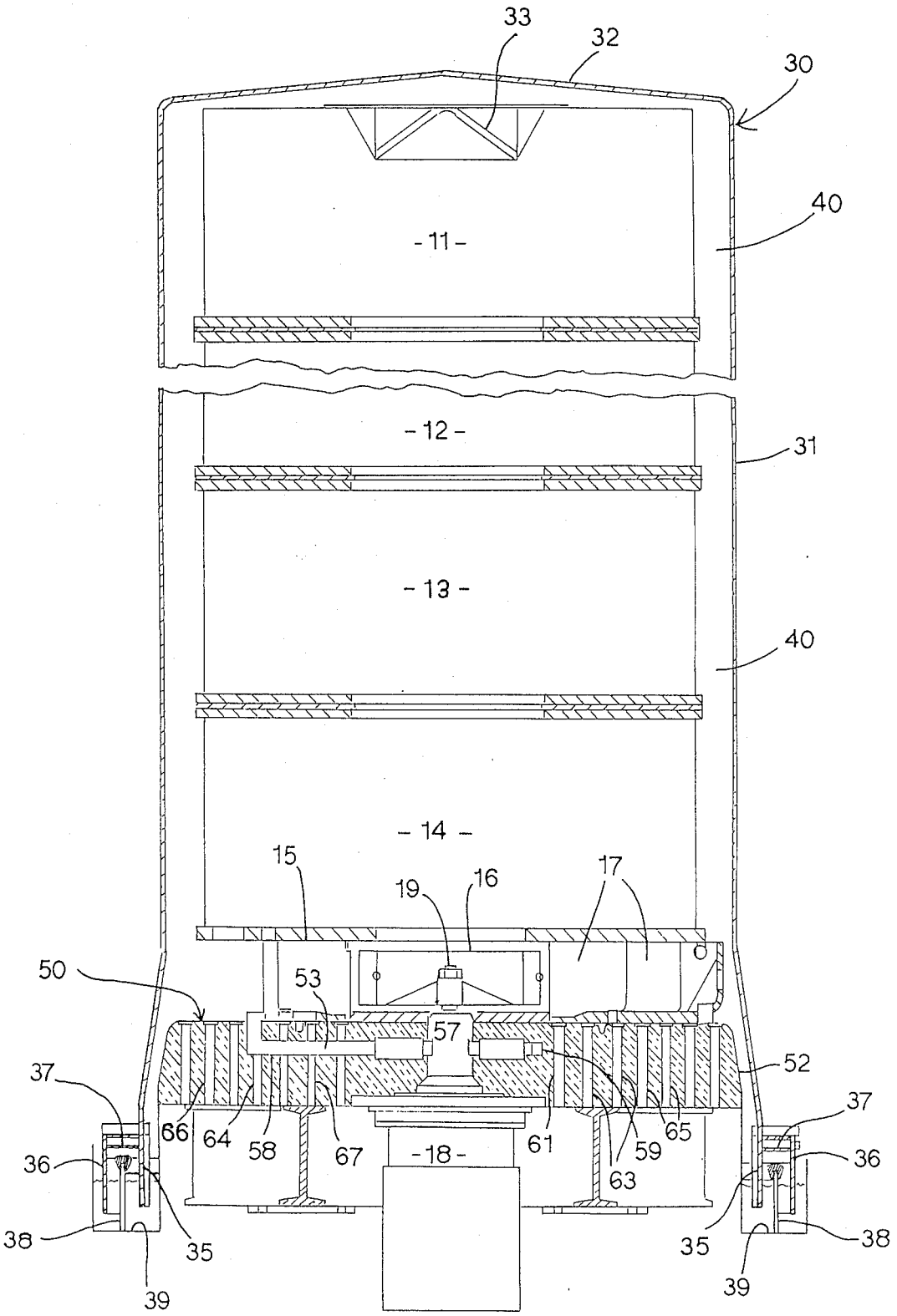
FIG. 2 is a broken sectional view on an enlarged scale of certain components of the annealing furnace of FIG. 1.

Referring more particularly to the drawings, and initially to FIG. 1, there is shown a heat treating furnace 10 for use in annealing a plurality of coils 11, 12, 13, and 14 of metal strip supported in the furnace in a vertical axis orientation one-on-top-of-the-other. The annealing is accomplished by circulating a hot inert gas to heat the strip.

The furnace includes a removable outer cover or bell 20, a removable inner cover 30, and an insulating base 50 that is sealingly connected to the lower edges of the side walls of the inner cover to define a sealed annealing compartment 40. The base 50 serves both to insulate the annealing compartment 40 from the surrounding support structure and to support the weight of the coils 11, 12, 13, and 14.

Also supported on the base 50 is a blower housing and diffuser structure 15 on which the coils 11, 12, 13, and 14 rest. A centrifugal blower 16 is located in the blower housing 15 and is adapted to force the inert gas in a tangential direction guided by diffuser vanes 17 toward the outer wall of the annealing compartment 40. The centrifugal blower 16 is driven by a blower motor 18 located below the base 50 and which has a motor shaft 19 that extends upward through the base 50 to the blower 16.

The outer cover or bell 20 has insulated walls 21 and a top 22 that are formed at least in part of thermal insulating material and rest on a support structure 23. The bell 20 also has a lifting eye 24 to permit the entire outer cover or bell to be lifted upward away from the inner cover and its contents to permit loading and unloading of the coils.

A number of radiant burner tubes 25 and 26 are located between the inside face of the outer walls 21 and the inner cover 30 for use in heating the inner cover and the inert gas contained therein to the desired annealing temperature.

The inner cover 30 comprises a cylindrical side wall 31 and a circular top 32, which also has a lifting eye 33 for use in removing the inner cover and replacing it over the coils to be annealed. The lower portion of the cylindrical side wall 31 has a pair of annular concentric seal flanges 35 and 36 connected by a web 37 that rests on an annular support wall 38 extending upwardly from the support structure. The annular support wall is located in an annular channel or trough 39 which, depending on recommended design. is filled with sand or water, for example, to seal the bottom of the inner cover 30 from the surrounding atmosphere. This prevents intrusion of outside oxygen-containing atmosphere to the annealing compartment, and also prevents escape of the inert gas from the annealing compartment to the outside atmosphere.

In the annealing process, the inert gas is driven by the centrifugal blower 16 toward the annular space adjacent the inner wall of the inner cover, and thus upward to the top of the annealing compartment and above the uppermost coil 11. The gas returns to the blower through the central opening through the coils.

As indicated above, the base 50 rests on the support structure on which the bell rests, and also is sealingly connected to the trough 39 in which the inner cover is sealed. Accordingly, the inner cover and the base 50 define the sealed annealing compartment 40. The base must insulate the annealing compartment from the surrounding structure in the same way that the bell 20 insulates the interior of the furnace from the surrounding atmosphere. Also, the base 50 must have sufficient strength to support the blower housing and diffuser as well as the coils 11, 12, 13, and 14.

Figure 3:
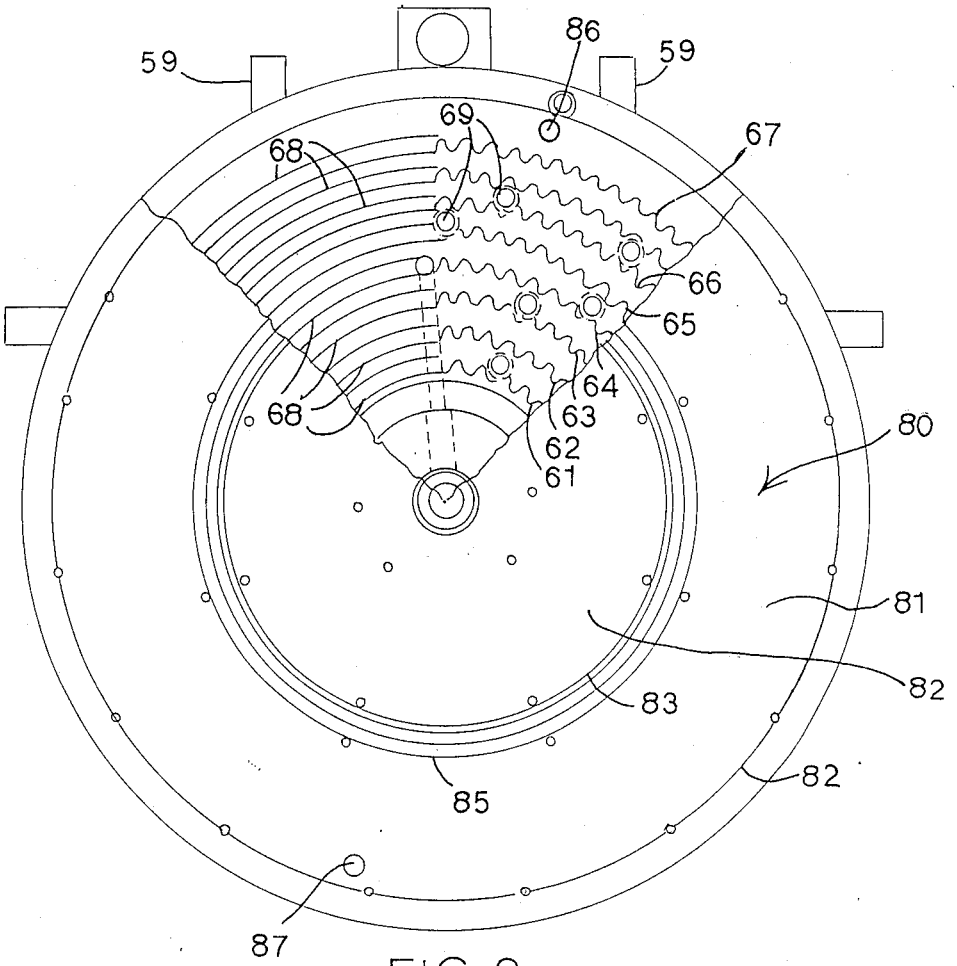
FIG. 3 is a horizontal section taken on the line 3—3 of FIG. 2, with parts broken away for the purpose of illustration and showing the construction of the annealing compartment base of the invention.

In accordance with the invention, the base 50 comprises an annular bottom plate 51, a frustoconical side wall 52, and a top plate assembly 80. The bottom plate 51 and the top plate assembly 80 have central openings 55 and 56, respectively, to receive a shaft bushing 57 through which the shaft 19 of the blower motor 18 extends. This is best shown in FIGS. 3 and 4.

Figure 4:
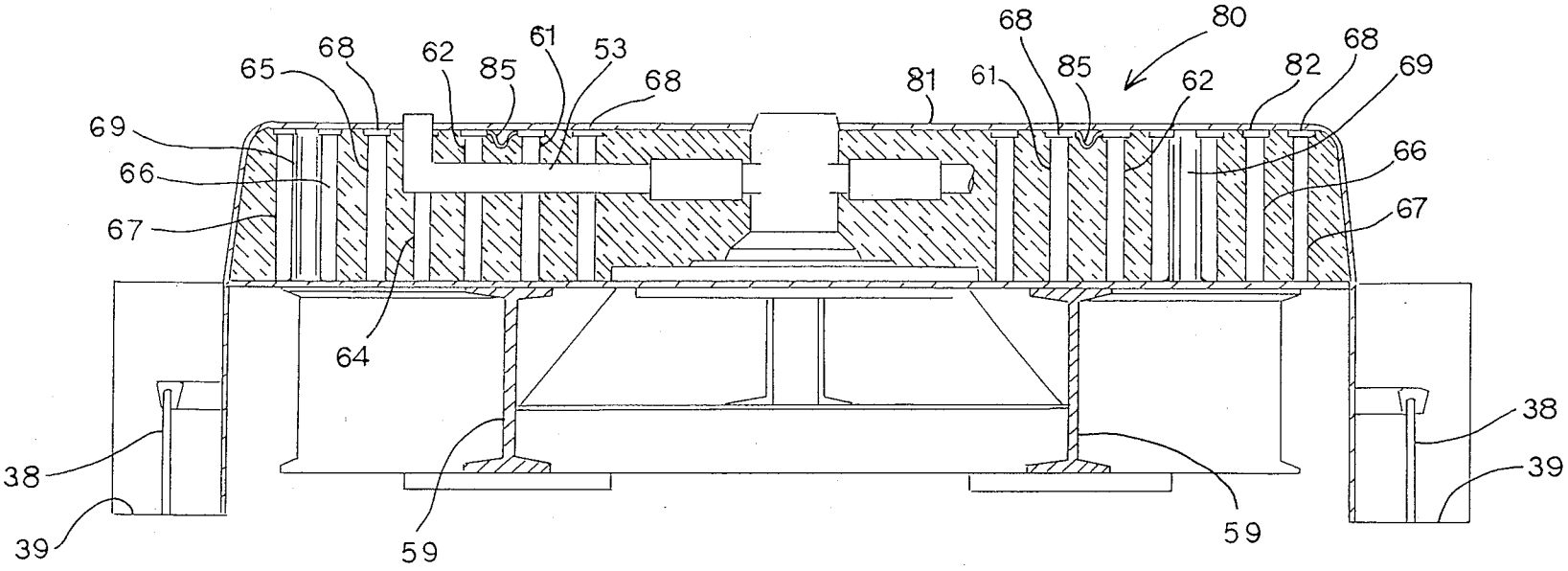
FIG. 4 is a sectional view on an enlarged scale, taken on the line 4—4 of FIG. 2 and illustrating the annealing compartment base of the invention, with the furnace bell and the inner cover removed.

The bottom plate 51 rests on several support beams such as the steel I-beams 59 shown in FIG. 4, as well as on other support structure. A pair of radially extending distributor tubes 53 and 54 extend from the shaft bushing 57 radially outward and then upward through openings in the top plate assembly 80 to accommodate pressure variations that occur during blower operations.

Located within the base 50 and welded to the bottom plate 51 are eight annular corrugated metal partitions 60 through 67 that are located vertically in a concentric pattern extending from the innermost to the outermost in a uniformly spaced pattern. The partitions define annular spaces between them which are filled with a thermal insulating material such as granular material or other suitable ceramic material of light weight and which need not bear any load. The load is transmitted from the top plate assembly 80 to the bottom plate 51 by the annular corrugated partitions.

On top of the partitions are arcuate pads 68 that are arranged end-to-end in a circular pattern around the top of each annular partition to form a circular bearing surface. The pads are adapted to accommodate sliding movement of the top plate assembly 80 in radial directions caused by thermal expansion and contraction during the annealing process.

The partitions are spaced from one another a desired distance by means of a plurality of spacer tubes 69 that extend between the bottom plate and the top plate assembly 80 to assure rigidity and uniformity of spacing. Also, drain tubes 75,76 are located at the bottom of the base to permit any moisture that accumulates in the interior to be drained away.

Figure 5:
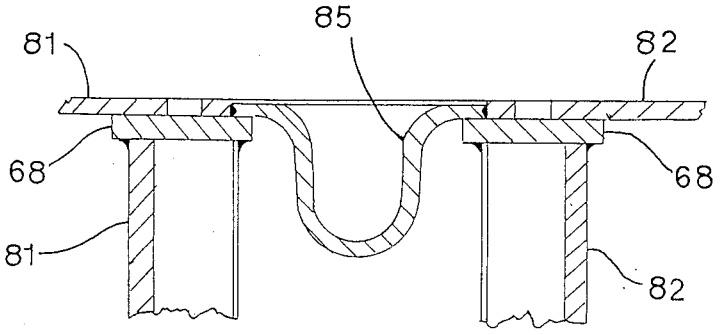
FIG. 5 is a fragmentary, sectional view showing the thermal expansion joint between the two circular sections of the top plate of the annealing compartment base of the invention.

The top plate assembly 80 comprises an annular inner section 81 and a larger diameter outer section 82. These sections 81 and 82 are concentric and spaced from one another to define an annular gap. The plates are connected to one another in the annular gap by a U-shaped annular expansion joint 85. The expansion joint, best shown in FIGS. 4 and 5, is welded to the respective circular edges of the sections 81 and 82 and, because of its U-shaped configuration, is capable of accommodating relative movement between the sections that would tend to decrease or enlarge the gap at the joint between the two sections. Accordingly, thermal expansion and contraction that occur during the annealing process are accommodated in a manner that reduces thermal stresses and prevents warping, etc. of the sections as might otherwise occur in the annealing process.

Passages 86 and 87 (FIG. 3) are provided in the base 50 for the initial evacuation of oxygen-containing atmosphere from the annealing compartment and for the introduction of the inert gas atmosphere.

It will be apparent that the annealing furnace base construction of the present invention: (1) provides sufficient strength to support the required load, (2) provides the required thermal insulation with minimal weight, (3) accommodates thermal expansion and contraction that occur at the floor surface of the annealing compartment, and (4) eliminates the need for an initial dry-out procedure as required in the case of conventional or castable ceramic base constructions.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly the patent is not to be limited in scope and effect to the specific embodiment herein shown and described nor in any other way that is inconsistent with the extent to which the progress in the art has been advanced by the invention.

What is claimed is:

1. A base for a heat treating furnace for annealing coils of steel strip located in a sealed compartment through which an inert gas is circulated, the base defining the bottom of the sealed compartment and being adapted to support thereon a plenum chamber assembly with a blower means associated therewith for circulating said inert gas through the compartment, and at least one of said coils on top of said assembly, said base comprising:

a top place assembly, a floor, and side walls to define therein a sealed enclosure;

a plurality of radially spaced upright annular concentric bearing partitions located in the enclosure, and having a corrugated form when viewed in horizontal section;

a plurality of upright cylindrical spacer tubes located in the enclosure and positioned in the annular space between adjacent bearing partitions to laterally support and maintain desired spacing between adjacent bearing partitions;

a plurality of arcuate pads mounted on the top of each of the annular partitions and positioned end-to-end to form a plurality of coplanar, concentric annular bearing rings corresponding to said annular partitions to define a bearing zone for the top plate assembly;

said annular bearing rings being adapted for slidingly engaging and supporting the top plate assembly in a manner to permit sliding movement of the assembly thereon caused by radial thermal expansion and contraction, said partitions and said spacer tubes defining a plurality of interior spaces constituting a substantial portion of the volume of said enclosure;

a lightweight discontinuous thermal insulating material located in and substantially filling said spaces;

said top plate assembly comprising at least two coplanar plate sections located one-within-the-other and separated by an annular gap;

an annular expansion joint located in said gap and joining said plate sections to one another to close and seal said gap, said joint having a "U"-shape when viewed in cross section whereby radial thermal expansion and contraction of said plate sections relative to one another are accommodated by said annular joint.

2. A base for a heat treating furnace as defined in claim 1, wherein the plate sections have circular inner and outer edges.

3. A base for a heat treating furnace as defined in claim 1, wherein the interior spaces between the annular partitions are filled with a granular thermal insulating material.

4. A base for a heat treating furnace as defined in claim 1, wherein said thermal insulating material is a granular material.

5. A base for a heat treating furnace as defined in claim 1, wherein said thermal insulating material is a ceramic material.

6. A base for a heat treating furnace as defined in claim 1, wherein said top plate assembly comprises two coplanar plate sections having about the same radial dimension.

* * * * *